US008586847B2

(12) United States Patent
Ellis et al.

(10) Patent No.: US 8,586,847 B2
(45) Date of Patent: Nov. 19, 2013

(54) MUSICAL FINGERPRINTING BASED ON ONSET INTERVALS

(75) Inventors: Daniel Ellis, New York, NY (US); Brian Whitman, Cambridge, MA (US)

(73) Assignee: The Echo Nest Corporation, Summerville, MA (US)

( * ) Notice: Subject to any disclaimer, the term of this patent is extended or adjusted under 35 U.S.C. 154(b) by 213 days.

(21) Appl. No.: 13/310,190

(22) Filed: Dec. 2, 2011

(65) Prior Publication Data

US 2013/0139673 A1 Jun. 6, 2013

(51) Int. Cl.
*G10H 3/00* (2006.01)

(52) U.S. Cl.
USPC ..... 84/603; 700/94

(58) Field of Classification Search
USPC ..... 84/600–603; 700/94
See application file for complete search history.

(56) References Cited

U.S. PATENT DOCUMENTS

| | | | | |
|---|---|---|---|---|
| 6,330,673 | B1 * | 12/2001 | Levine | 713/176 |
| 6,453,252 | B1 * | 9/2002 | Laroche | 702/75 |
| 6,990,453 | B2 * | 1/2006 | Wang et al. | 704/270 |
| 7,013,301 | B2 * | 3/2006 | Holm et al. | 707/741 |
| 7,080,253 | B2 * | 7/2006 | Weare | 713/176 |
| 7,081,579 | B2 * | 7/2006 | Alcalde et al. | 84/608 |
| 7,193,148 | B2 * | 3/2007 | Cremer et al. | 84/635 |
| 7,273,978 | B2 * | 9/2007 | Uhle | 84/609 |
| 7,277,766 | B1 * | 10/2007 | Khan et al. | 700/94 |
| 7,313,571 | B1 * | 12/2007 | Platt et al. | 1/1 |
| 7,487,180 | B2 * | 2/2009 | Holm et al. | 1/1 |
| 7,518,053 | B1 | 4/2009 | Jochelson et al. | |
| 7,643,994 | B2 * | 1/2010 | Kemp | 704/243 |
| 8,071,869 | B2 * | 12/2011 | Chen et al. | 84/612 |
| 8,140,331 | B2 * | 3/2012 | Lou | 704/243 |
| 8,190,435 | B2 * | 5/2012 | Li-Chun Wang et al. | 704/270 |
| 8,195,689 | B2 * | 6/2012 | Ramanathan et al. | 707/769 |
| 8,290,423 | B2 * | 10/2012 | Wang | 455/2.01 |
| 8,492,633 | B2 * | 7/2013 | Whitman et al. | 84/609 |
| 2002/0138730 | A1 * | 9/2002 | Kim | 713/176 |
| 2002/0178012 | A1 * | 11/2002 | Wang et al. | 704/503 |
| 2002/0181711 | A1 * | 12/2002 | Logan et al. | 381/1 |
| 2003/0086341 | A1 * | 5/2003 | Wells et al. | 369/13.56 |
| 2003/0191764 | A1 * | 10/2003 | Richards | 707/100 |
| 2003/0205124 | A1 | 11/2003 | Foote et al. | |

(Continued)

OTHER PUBLICATIONS

Bello et al., A Tutorial on Onset Detection in Music Signals, Journal, IEEE Transactions on Speech and Audio Processing, 2005, pp. 1-13.

(Continued)

*Primary Examiner* — David S. Warren
(74) *Attorney, Agent, or Firm* — SoCal IP Law Group LLP; John E. Gunther; Steven C. Sereboff

(57) ABSTRACT

Methods, computing devices, and machine readable storage media for generating a fingerprint of a music sample. The music sample may be filtered into a plurality of frequency bands. Onsets in each of the frequency bands may be independently detected. Inter-onset intervals between pairs of onsets within the same frequency band may be determined. At least one code associated with each onset may be generated, each code comprising a frequency band identifier identifying a frequency band in which the associated onset occurred and one or more inter-onset intervals. Each code may be associated with a timestamp indicating when the associated onset occurred within the music sample. All generated codes and the associated timestamps may be combined to form the fingerprint.

21 Claims, 9 Drawing Sheets

(56) References Cited

U.S. PATENT DOCUMENTS

| | | | | |
|---|---|---|---|---|
| 2004/0181403 | A1* | 9/2004 | Hsu | 704/230 |
| 2004/0260682 | A1* | 12/2004 | Herley et al. | 707/3 |
| 2005/0226431 | A1* | 10/2005 | Mao | 381/61 |
| 2006/0065105 | A1 | 3/2006 | Iketani et al. | |
| 2006/0075886 | A1 | 4/2006 | Cremer et al. | |
| 2006/0149552 | A1* | 7/2006 | Bogdanov | 704/273 |
| 2007/0180980 | A1* | 8/2007 | Kim | 84/612 |
| 2008/0060505 | A1* | 3/2008 | Chang et al. | 84/612 |
| 2008/0097633 | A1 | 4/2008 | Jochelson et al. | |
| 2008/0189120 | A1* | 8/2008 | Oh et al. | 704/501 |
| 2008/0201140 | A1* | 8/2008 | Wells et al. | 704/231 |
| 2008/0256106 | A1* | 10/2008 | Whitman | 707/101 |
| 2009/0157391 | A1* | 6/2009 | Bilobrov | 704/200.1 |
| 2009/0235079 | A1* | 9/2009 | Baum et al. | 713/176 |
| 2011/0026763 | A1* | 2/2011 | Diggins | 382/100 |
| 2011/0112669 | A1* | 5/2011 | Scharrer et al. | 700/94 |
| 2011/0128444 | A1* | 6/2011 | Oostveen et al. | 348/500 |
| 2011/0173208 | A1* | 7/2011 | Vogel | 707/746 |
| 2011/0223997 | A1* | 9/2011 | Mao | 463/36 |
| 2011/0225150 | A1* | 9/2011 | Whitman | 707/723 |
| 2012/0160078 | A1* | 6/2012 | Lyon et al. | 84/609 |
| 2012/0191231 | A1* | 7/2012 | Wang | 700/94 |
| 2012/0209612 | A1* | 8/2012 | Bilobrov | 704/270 |
| 2012/0290307 | A1* | 11/2012 | Kim et al. | 704/500 |
| 2012/0294457 | A1* | 11/2012 | Chapman et al. | 381/98 |
| 2013/0000467 | A1* | 1/2013 | Lyon et al. | 84/609 |
| 2013/0091167 | A1* | 4/2013 | Bertin-Mahieux et al. | 707/769 |
| 2013/0128115 | A1* | 5/2013 | Oostveen et al. | 348/515 |
| 2013/0132210 | A1* | 5/2013 | Kim et al. | 705/14.72 |
| 2013/0139673 | A1* | 6/2013 | Ellis et al. | 84/609 |
| 2013/0139674 | A1* | 6/2013 | Whitman et al. | 84/609 |
| 2013/0160038 | A1* | 6/2013 | Slaney et al. | 725/14 |
| 2013/0197913 | A1* | 8/2013 | Bilobrov | 704/270 |

OTHER PUBLICATIONS

Ellis et al., The Echo Nest Musical Fingerprint, International Society for Music Information Retrieval, 2010 journal, p. 1.

Haitsma et al., A Highly Robust Audio Fingerprinting System, A Highly Robust Audio Fingerprinting System, 2002 journal, pp. 1-9.

Stowell et al., Adaptive Whitening for Improved Real-Time Audio Onset Detection, Centre for Digital Music, 2007 journal, pp. 1-8.

Avery Li-Chun Wang, An Industrial-Strength Audio Search Algorithm, Shazam Entertainment, Ltd., 2003 journal, pp. 1-7.

Daniel Ellis et al., The Echo Nest Musical Fingerprint, Proceedings of the 2010 International Symposium on Music Information Retrieval, Aug. 12, 2010.

Daniel Ellis et al., Echoprint—An Open Music Identification Service, Proceedings of the 2011 International Symposium on Music Information Retrieval, Oct. 28, 2011.

Tristan Jehan, Downbeat Prediction by Listening and Learning, Oct. 16-19, 2005, IEEE Workshop on Applications of Signal Processing to Audio and Acoustics, New Paltz, NY.

Jarno Seppanen et al., Joint Beat & Tatum Tracking from Music Signals, Journal, pp. 1-6.

* cited by examiner

MUSICAL FINGERPRINTING BASED ON ONSET INTERVALS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to developing a fingerprint of an audio sample and identifying the sample based on the fingerprint.

2. Description of the Related Art

The "fingerprinting" of large audio files is becoming a necessary feature for any large scale music understanding service or system. "Fingerprinting" is defined herein as converting an unknown music sample, represented as a series of time-domain samples, to a match of a known song, which may be represented by a song identification (ID). The song ID may be used to identify metadata (song title, artist, etc.) and one or more recorded tracks containing the identified song (which may include tracks of different bit rate, compression type, file type, etc.). The term "song" refers to a musical performance as a whole, and the term "track" refers to a specific embodiment of the song in a digital file. Note that, in the case where a specific musical composition is recorded multiple times by the same or different artists, each recording is considered a different "song". The term "music sample" refers to audio content presented as a set of digitized samples. A music sample may be all or a portion of a track, or may be all or a portion of a song recorded from a live performance or from an over-the-air broadcast.

Examples of fingerprinting have been published by Haitsma and Kalker (A highly robust audio fingerprinting system with an efficient search strategy, *Journal of New Music Research,* 32(2):211-221, 2003), Wang (An industrial strength audio search algorithm, *International Conference on Music Information Retrieval* (*ISMIR*)2003), and Ellis, Whitman, Jehan, and Lamere (The Echo Nest musical fingerprint, *International Conference on Music Information Retrieval* (*ISMIR*)2010).

Fingerprinting generally involves compressing a music sample to a code, which may be termed a "fingerprint", and then using the code to identify the music sample within a database or index of songs.

Elements in figures are assigned three-digit reference designators, wherein the most significant digit is the figure number where the element was introduced. Elements not described in conjunction with a figure may be presumed to have the same form and function as a previously described element having the same reference designator.

DETAILED DESCRIPTION

Description of Processes

Figure 1:
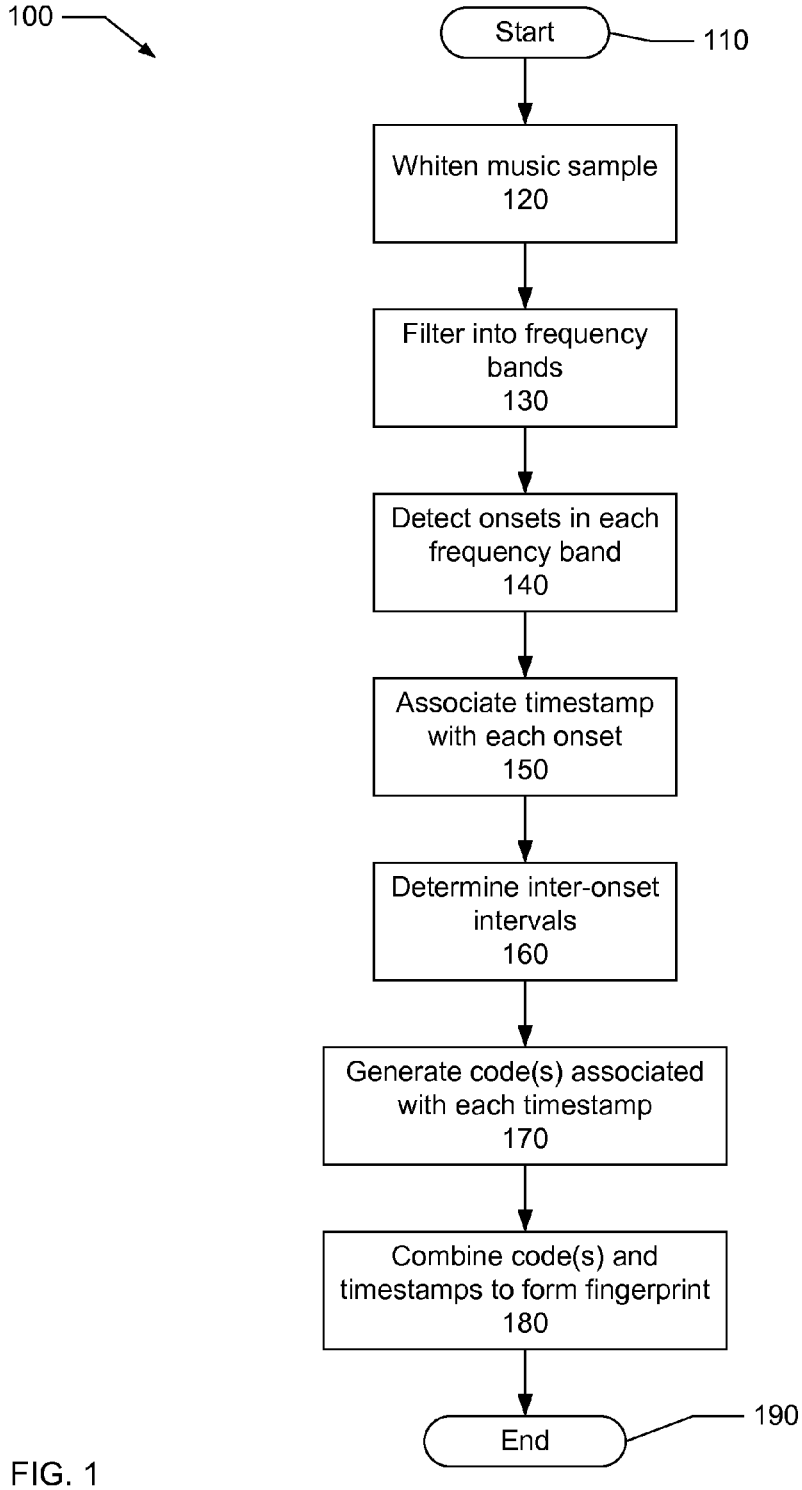
FIG. 1 is a flow chart of a process for generating a fingerprint of a music sample.

FIG. 1 shows a flow chart of a process 100 for generating a fingerprint representing the content of a music sample. The process 100 may begin at 110, when the music sample is provided as a series of digitized time-domain samples, and may end at 190 after a fingerprint of the music sample has been generated. The process 100 may provide a robust reliable fingerprint of the music sample based on the relative timing of successive onsets, or beat-like events, within the music sample. In contrast, previous musical fingerprints typically relied upon spectral features of the music sample in addition to, or instead of, temporal features like onsets.

At 120, the music sample may be "whitened" to suppress strong stationary resonances that may be present in the music sample. Such resonances may be, for example, artifacts of the speaker, microphone, room acoustics, and other factors when the music sample is recorded from a live performance or from an over-the-air broadcast. "Whitening" is a process that flattens the spectrum of a signal such that the signal more closely resembles white noise (hence the name "whitening").

At 120, the time-varying frequency spectrum of the music sample may be estimated. The music sample may then be filtered using a time-varying inverse filter calculated from the frequency spectrum to flatten the spectrum of the music sample and thus moderate any strong resonances. For example, at 120, a linear predictive coding (LPC) filter may be estimated from the autocorrelation of one second blocks for the music sample, using a decay constant of eight seconds. An inverse finite impulse response (FIR) filter may then be calculated from the LPC filter. The music sample may then be filtered using the FIR filter. Each strong resonance in the music sample may be thus moderated by a corresponding zero in the FIR filter.

At 130, the whitened music sample may be partitioned into a plurality of frequency bands using a corresponding plurality of band-pass filters. Ideally, each band may have sufficient bandwidth to allow accurate measurement of the timing of the music signal (since temporal resolution has an inverse relationship with bandwidth). At the same time, the probability that a band will be corrupted by environmental noise or channel effects increases with bandwidth. Thus the number of bands and the bandwidths of each band may be determined as a compromise between temporal resolution and a desire to obtain multiple uncorrupted views of the music sample.

For example, at 130, the music sample may be filtered using the lowest eight filters of the MPEG-Audio 32-band filter bank to provide eight frequency bands spanning the frequency range from 0 to about 5500 Hertz. More or fewer than eight bands, spanning a narrower or wider frequency range, may be used. The output of the filtering will be referred to herein as "filtered music samples", with the understanding that each filtered music sample is a series of time-domain samples representing the magnitude of the music sample within the corresponding frequency band.

At 140, onsets within each filtered music sample may be detected. An "onset" is the start of period of increased magnitude of the music sample, such as the start of a musical note or percussion beat. Onsets may be detected using a detector for each frequency band. Each detector may detect increases in the magnitude of the music sample within its respective frequency band. Each detector may detect onsets, for example, by comparing the magnitude of the corresponding filtered music sample with a fixed or time-varying threshold derived from the current and past magnitude within the respective band.

At 150, a timestamp may be associated with each onset detected at 140. Each timestamp may indicate when the associated onset occurs within the music sample, which is to say the time delay from the start of the music sample until the occurrence of the associated onset. Since extreme precision is not necessarily required for comparing music samples, each timestamp may be quantized in time intervals that reduce the amount of memory required to store timestamps within a fingerprint, but are still reasonably small with respect to the anticipated minimum inter-onset interval. For example, the timestamps may be quantized in units of 23.2 milliseconds, which is equivalent to 1024 sample intervals if the audio sample was digitized at a conventional rate of 44,100 samples per second. In this case, assuming a maximum music sample length of about 47 seconds, each time stamp may be expressed as an eleven-bit binary number.

The fingerprint being generated by the process 100 is based on the relative location of onsets within the music sample. The fingerprint may subsequently be used to search a music library database containing a plurality of similarly-generated fingerprints of known songs. Since the music sample will be compared to the known songs based on the relative, rather than absolute, timing of onsets, the length of a music sample may exceed the presumed maximum sample length (such that the time stamps assigned at 150 "wrap around" and restart at zero) without significantly degrading the accuracy of the comparison.

At 160, inter-onset intervals (IOIs) may be determined. Each IOI may be the difference between the timestamps associated with two onsets within the same frequency band. IOIs may be calculated, for example, between each onset and the first succeeding onset, between each onset and the second succeeding onset, or between other pairs of onsets.

IOIs may be quantized in time intervals that are reasonably small with respect to the anticipated minimum inter-onset interval. The quantization of the IOIs may be the same as the quantization of the timestamps associated with each onset at 150. Alternatively, IOIs may be quantized in first time units and the timestamps may be quantized in longer time units to reduce the number of bits required for each timestamp. For example, IOIs may be quantized in units of 23.2 milliseconds, and the timestamps may be quantized in longer time units such as 46.4 milliseconds or 92.8 milliseconds. Assuming an average onset rate of about one onset per second, each inter-onset interval may be expressed as a six or seven bit binary number.

At 170, one or more codes may be associated with some or all of the onsets detected at 140. Each code may include one or more IOIs indicating the time interval between the associated onset and a subsequent onset. Each code may also include a frequency band identifier indicating the frequency band in which the associated onset occurred. For example, when the music sample is filtered into eight frequency bands at 130 in the process 100, the frequency band identifier may be a three-bit binary number. Each code may be associated with the timestamp associated with the corresponding onset.

At 170, multiple codes may be associated with each onset. For example, two, three, six, or more codes may be associated with each onset. Each code associated with a given onset may be associated with the same timestamp and may include the same frequency band identifier. Multiple codes associated with the same onset may contain different IOIs or combinations of IOIs. For example, three codes may be generated that include the IOIs from the associated onset to each of the next three onsets in the same frequency band, respectively.

At 180, the codes determined at 170 may be combined to form a fingerprint of the music sample. The fingerprint may be a list of all of the codes generated at 170 and the associated timestamps. The codes may be listed in timestamp order, in timestamp order by frequency band, or in some other order. The ordering of the codes may not be relevant to the use of the fingerprint. The fingerprint may be stored and/or transmitted over a network before the process 100 ends at 190.

Figure 2:
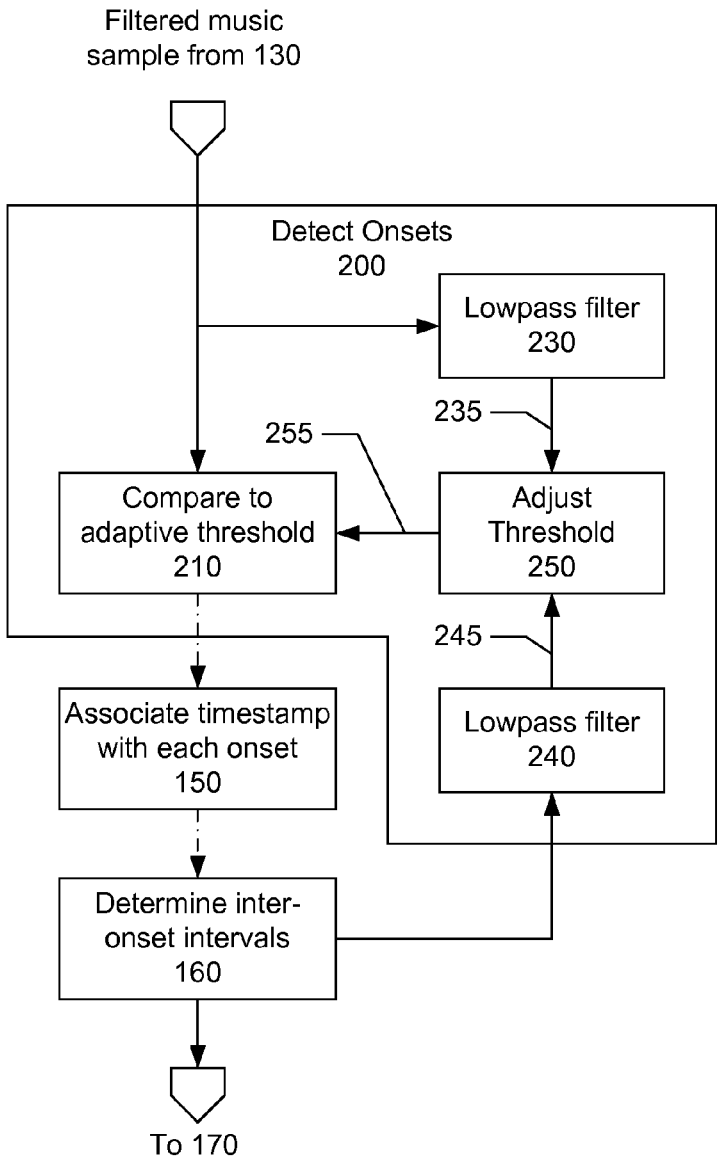
FIG. 2 is a flow chart of a process for adaptive onset detection.

Referring now to FIG. 2, a method of detecting onsets 200 may be suitable for use at 140 in the process 100 of FIG. 1. The method 200 may be performed independently and concurrently for each of the plurality of filtered music samples from 130 in FIG. 1. At 210, a magnitude of a filtered music sample may be compared to an adaptive threshold 255. In this context, an "adaptive threshold" is a threshold that varies or adapts in response to one or more characteristics of the filtered music sample. An onset may be detected at 210 each time the magnitude of the filtered music sample rises above the adaptive threshold. To reduce susceptibility to noise in the original music sample, an onset may be detected at 210 only when the magnitude of the filtered music sample rises above the adaptive threshold for a predetermined period of time.

At 230 the filtered music sample may be low-pass filtered to effectively provide a recent average magnitude of the filtered music sample 235. At 240, onset intervals determined at 160 based on onsets detected at 210 may be low-pass filtered to effectively provide a recent average inter-onset interval 245. At 250, the adaptive threshold may be adjusted in response to the recent average magnitude of the filtered music sample 235 and/or the recent average inter-onset interval 245, and/or some other characteristic of, or derived from, the filtered music sample.

Figure 3:
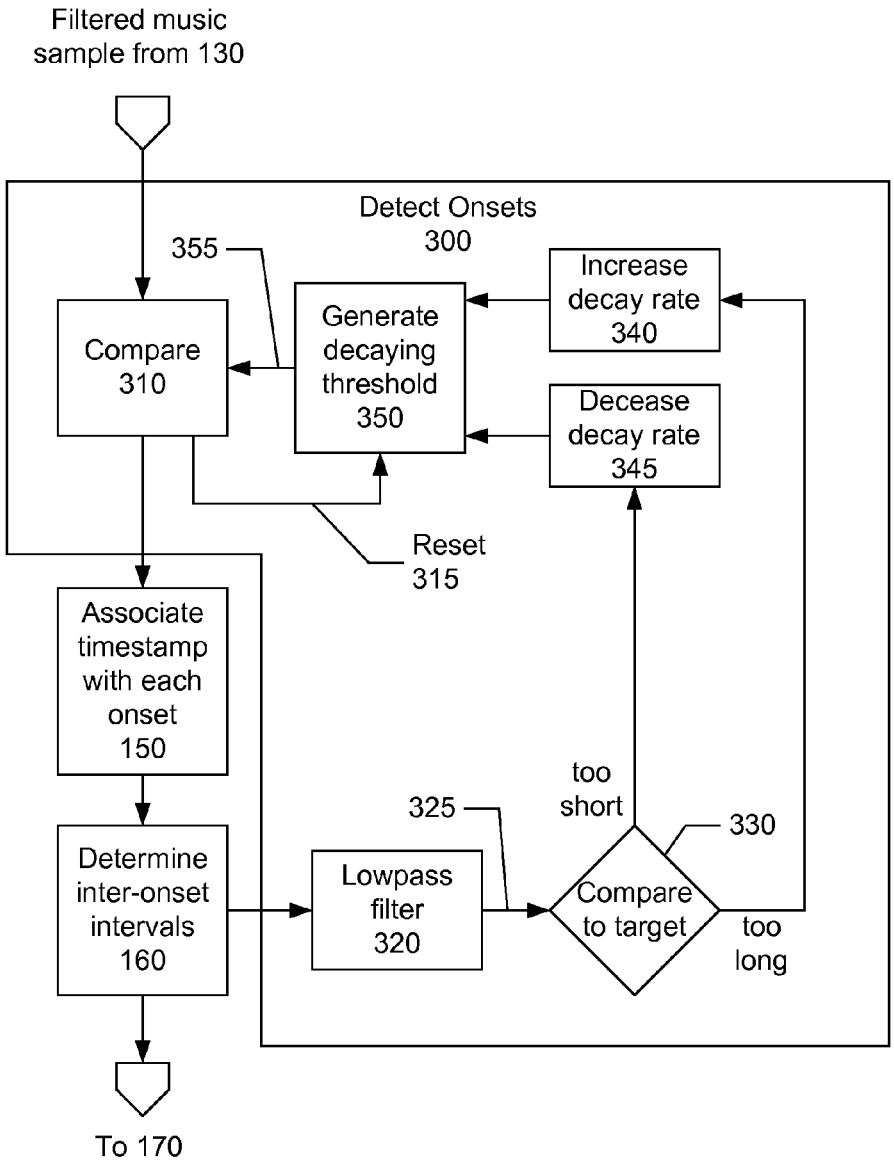
FIG. 3 is a flow chart of another process for adaptive onset detection.

Referring now to FIG. 3, another method of detecting onsets 300 may be suitable for use at 140 in the process 100 of FIG. 1. The method 300 may be performed independently and concurrently for each of the plurality of filtered music samples from 130 in FIG. 1. At 310, a magnitude of a filtered music sample may be compared to a decaying threshold 355, which is to say a threshold that becomes progressively lower in value over time. An onset may be detected at 310 each time the magnitude of the filtered music sample rises above the decaying threshold 355. To reduce susceptibility to noise in the original music sample, an onset may be detected at 310 only when the magnitude of the filtered music sample rises above the decaying threshold 350 for a predetermined period of time.

When an onset is detected at 310, the decaying threshold 355 may be reset to a higher value. Functionally, the decaying threshold 355 may be considered to be reset in response to a reset signal 315 provided from 310. The decaying threshold 355 may be reset to a value that adapts to the magnitude of the filtered music sample. For example, the decaying threshold 355 may be reset to a value higher, such as five percent or ten percent higher, than a peak magnitude of the filtered music sample following each onset detected at 310.

At 320, onset intervals determined at 160 from onsets detected at 310 may be low-pass filtered to effectively provide a recent average inter-onset interval 325. At 330, the recent average inter-onset interval 325 may be compared to a target value derived from a target onset rate. For example, the recent average inter-onset interval 325 may be inverted to determine a recent average onset rate that is compared to a target onset rate of one onset per second, two onsets per second, or some other predetermined target onset rate. When a determination is made at 330 that the recent average inter-onset interval 325 is too short (average onset rate higher than the predetermined target onset rate), the decay rate of the decaying threshold 355 may be reduced at 345. Reducing the decay rate will cause the decaying threshold value to change more slowly, which may increase the intervals between successive onset detections. When a determination is made at 330 that the recent average inter-onset interval 325 is too long (average onset rate smaller than the predetermined target onset rate), the decay rate of the decaying threshold 355 may be increased at 340. Increasing the decay rate will cause the decaying threshold value to change more quickly, which may decrease the intervals between successive onset detections.

The target onset rate may be determined as a compromise between the accuracy with which a music sample can be matched to a song from a music library, and the computing resources required to store the music library and perform the matching. A higher target onset rate leads to more detailed descriptions of each music sample and song, and thus provides more accurate matching. However, a higher target onset rate results in slower, more computationally intensive matching process and a proportionally larger music library. A rate of about one onset per second may be a good compromise.

Figure 4:
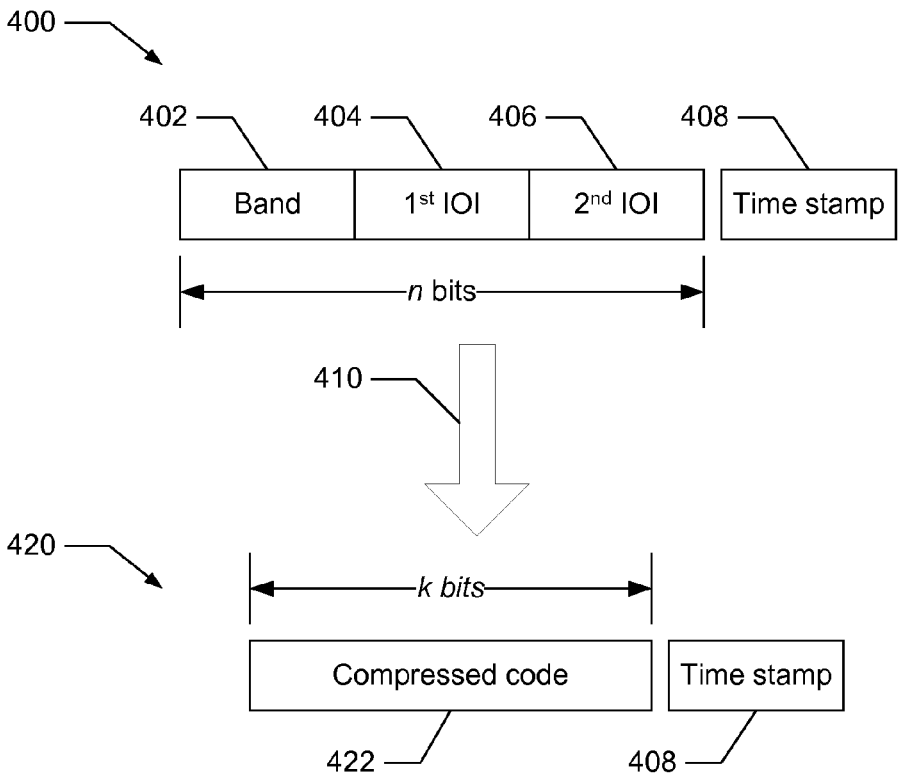
FIG. 4 is a graphical representation of a code.

Referring now to FIG. 4, a code 400, which may be a code generated at 170 in the process 100 of FIG. 1, may include a frequency band identifier 402, a first IOI 404, and a second IOI 406. The code 400 may be associated with a timestamp 408. The frequency band identifier 402 may identify the frequency band in which an associated onset occurred. The first IOI 404 may indicate the time interval between the associated onset and a selected subsequent onset, which may not necessarily be the next onset within the same frequency band. The second IOI 406 may indicate the time interval between a pair of onsets subsequent to the associated onset within the same frequency band. The order of the fields in the code 400 is exemplary, and other arrangements of the fields are possible.

The frequency band identifier 402, the first IOI 404, and the second IOI 406 may contain a total of n binary bits, where n is a positive integer. n may typically be in the range of 13-18. For example, the code 400 may include a 3-bit frequency band identifier and two 6-bit IOIs for a total of fifteen bits. Not all of the possible values of the n bits may be found in any given music sample. For example, typical music samples may have few, if any, IOI values within the lower half or lower one-third of the possible range of IOI values. Since not all possible combinations of the n bits are used, it may be possible to compress each code 400 using a hash function 410 to produce a compressed code 420. In this context, a "hash function" is any mathematical manipulation that compresses a binary string into a shorter binary string. Since the compressed codes will be incorporated into a fingerprint used to identify, but not reproduce, a music sample, the hash function 410 need not be reversible. The hash function 410 may be applied to the binary string formed by the frequency band identifier 402, the first IOI 404, and the second IOI 406 to generate the compressed code 420. The timestamp 408 may be preserved and associated with the compressed code 420.

Figure 5:
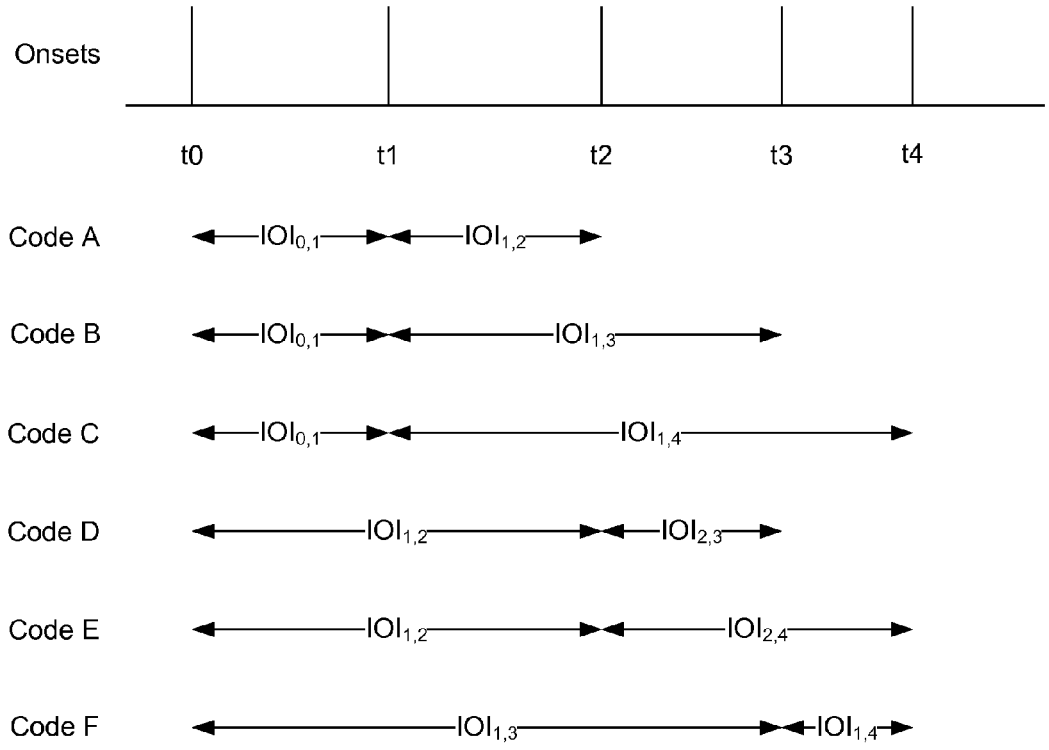
FIG. 5 is a graphical representation of onset interval pairs.

FIG. 5 is a graphical representation of an exemplary set of six codes that may be associated with a specific onset. For purposes of discussion, assume that the specific onset occurs at a time t0 and subsequent onsets in the same frequency band occur at times t1, t2, t3, and t4. The identifiers t0-t4 refer both to the time when the onsets occurred and the timestamps assigned to the respective onsets. Six codes, identified as "Code A" through "Code F" may be generated for the specific onset. Each code may have the format of the code 400 of FIG. 4. Each code may include a first IOI indicating the time interval from t0 to a first subsequent onset and a second IOI indicating the time interval from the first subsequent onset to a second subsequent onset. The first subsequent onset and the second subsequent onset may be selected from all possible pairs of the four onsets following the onset at t0. Each of the six codes (Code A-Code F) may also include a frequency band identifier (not shown) and may be associated with timestamp t0.

Code A may contain the IOI from t0 to t1, and the IOI from t1 to t2. Code B may contain the IOI from t0 to t1, and the IOI from t1 to t3. Code C may contain the IOI from t0 to t1, and the IOI from t1 to t4. Code D may contain the IOI from t0 to t2, and the IOI from t2 to t3. Code E may contain the IOI from t0 to t2, and the IOI from t1 to t4. Code F may contain the IOI from t0 to t3, and the IOI from t3 to t4.

Figure 6:
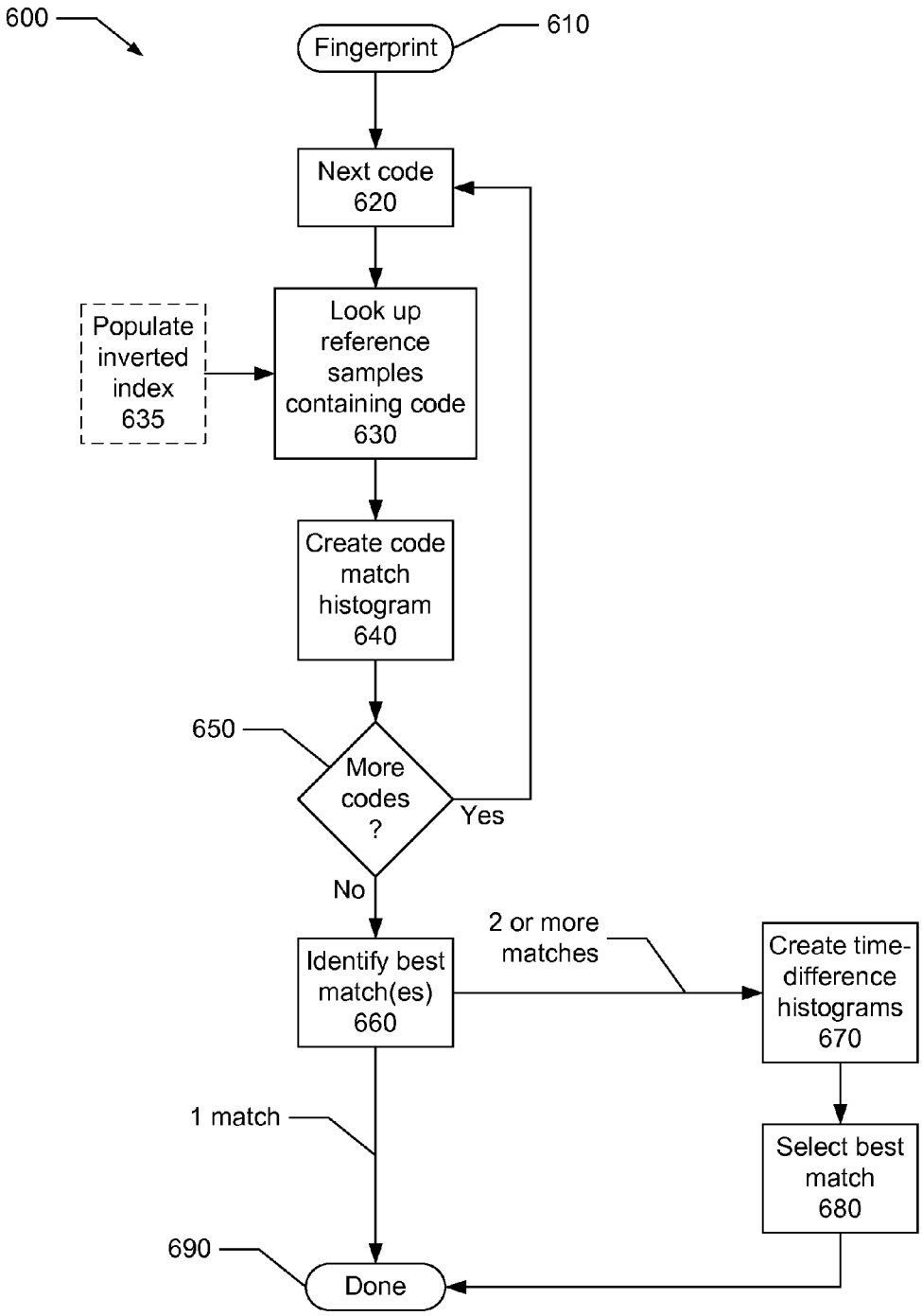
FIG. 6 is a flow chart of a process for recognizing music based on a fingerprint.

Referring now to FIG. 6, a process 600 for identifying a song based on a fingerprint may begin at 610 when the fingerprint is provided. The fingerprint may have been derived from an unknown music sample using, for example, the process 100 shown in FIG. 1. The process 600 may finish at 690 after a single song from a library of songs has been identified.

The fingerprint provided at 610 may contain a plurality of codes (which may be compressed or uncompressed) representing the unknown music sample. Each code may be associated with a time stamp. At 620, a first code from the plurality of codes may be selected. At 630, the selected code may be used to access an inverted index for a music library containing a large plurality of songs.

Figure 7:
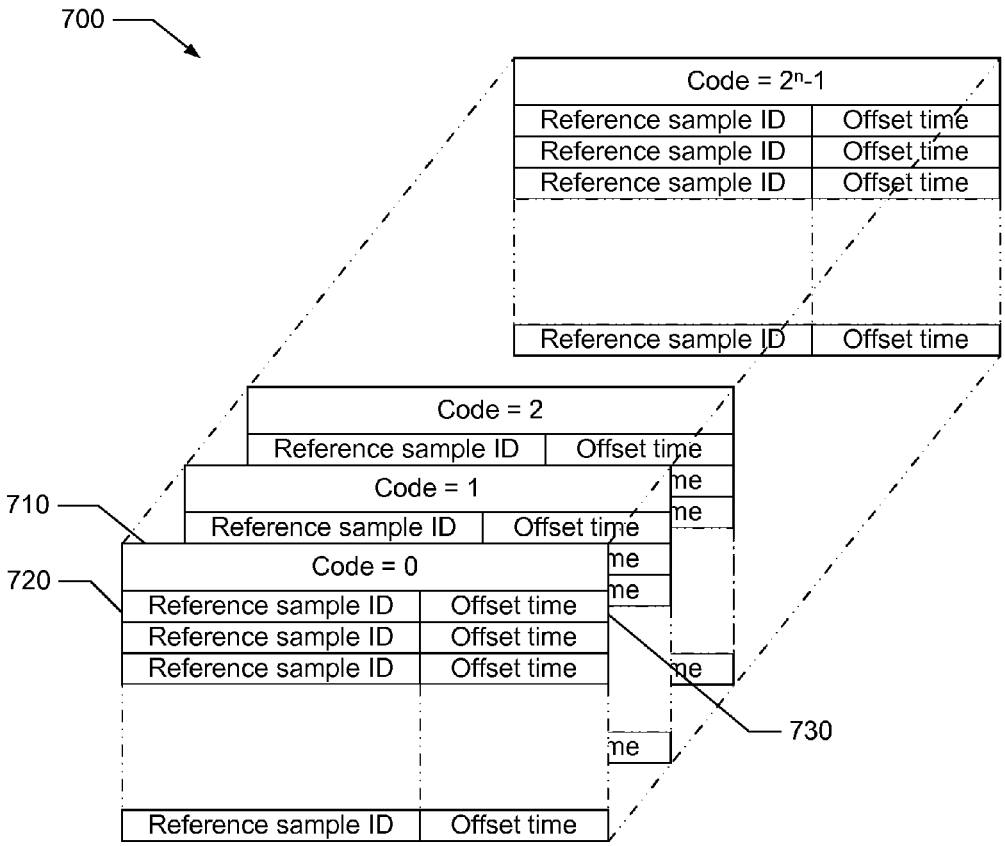
FIG. 7 is a graphical representation of an inverted index.

Referring now to FIG. 7, an inverted index 700 may be suitable for use at 630 in the process 600. The inverted index 700 may include a respective list, such as the list 710, for each possible code value. The code values used in the inverted index may be compressed or uncompressed, so long as the inverted index is consistent with the type of codes within the fingerprint. Continuing the previous example, in which the music sample is represented by a plurality of 15-bit codes, the inverted index 700 may include $2^{15}$ lists of reference samples. The list associated with each code value may contain the reference sample ID 720 of each reference sample in the music library that contains the code value. Each reference sample may be all or a portion of a track in the music library. For example, each track in the music library may be divided into overlapping 30-second reference samples. Each track in the music library may be partitioned into reference samples in some other manner.

The reference sample ID may be an index number or other identifier that allows the track that contained the reference sample to be identified. The list associated with each code value may also contain an offset time 730 indicating where the code value occurs within the identified reference sample. In situations where a reference sample contains multiple segments having the same code value, multiple offset times may be associated with the reference sample ID.

Referring back to FIG. 6, an inverted index, such as the inverted index 700, may be populated at 635 by applying the process 100, as shown in FIG. 1, to reference samples drawn from some or all tracks in a library containing a large plurality of tracks. In the situation where the library contains multiple tracks of the same song, a representative track may be used to populate the inverted index. The process used at 635 to generate fingerprints for the reference samples may not necessarily be the same as the process used to generate the music sample fingerprint. The number and bandwidth of the filter bands and the target onset rate used to generate fingerprints of the reference samples and the music sample may be the same. However, since the fingerprints of the reference samples may be generated from an uncorrupted source, such as a CD track, the number of codes generated for each onset may be smaller for the reference tracks than for the music sample.

At 640, a code match histogram may be developed. The code match histogram may be a list of all of the reference sample IDs for reference samples that match at least one code from the fingerprint and a count value associated with each listed reference sample ID indicating how many codes from the fingerprint matched that reference sample.

At 650, a determination may be made if more codes from the fingerprint should be considered. When there are more codes to consider, the actions from 620 to 650 may be repeated cyclically for each code. Specifically, at 630 each additional code may be used to access the inverted index. At 640, the code match histogram may be updated to reflect the reference samples that match the additional codes.

The actions from 620 to 650 may be repeated cyclically until all codes contained in the fingerprint have been processed. The actions from 620 to 650 may be repeated until either all codes from the fingerprint have been processed or until a predetermined maximum number of codes have been processed. The actions from 620 to 650 may be repeated until all codes from the fingerprint have been processed or until the histogram built at 640 indicates a clear match between the music sample and one of the reference samples. The determination at 650 whether or not to process additional codes may be made in some other manner.

When a determination is made at 650 that no more codes should be processed, one or more best matches may be identified at 660. In the simplest case, one reference sample may match all or nearly all of the codes from the fingerprint, and no other reference sample may match more than a small fraction of the codes. In this case, the unknown music sample may be identified as a portion of the single track that contains the reference sample that matched all or nearly all of the codes. In the more complex case, two or more candidate reference samples may match a significant portion of the codes from the fingerprint, such that a single reference sample matching the unknown music sample cannot be immediately identified. The determination whether one or more reference samples match the unknown music sample may be made based on predetermined thresholds. The height of the highest peak in the histogram may provide a confidence factor indicating a confidence level in the match. The confidence factor may be derived from the absolute height or the number of matches of the highest peak. The confidence factor may be derived from the relative height (number of matches in the highest peak divided by a total number of matches in the histogram) of the highest peak. In some situations, for example when no reference sample matches more than a predetermined fraction of the codes from the music sample, a determination may be made that no track in the music library matches the unknown music sample.

When only a single reference sample matches the music sample, the process 600 may end at 690. When two or more candidate reference samples are determined to possibly match the music sample, the process 600 may continue at 670. At 670, a time-offset histogram may be created for each candidate reference sample. For each candidate reference sample, the difference between the associated timestamp from the fingerprint and the offset time from the inverted index may be determined for each matching code and a histogram may be created from the time-difference values. When the unknown music sample and a candidate reference sample actually match, the histogram may have a pronounced peak. Note that the peak may not be at time=0 because the start of the unknown music sample may not coincide with the start of the reference sample. When a candidate reference sample does not, in fact, match the unknown music sample, the corresponding time-difference histogram may not have a pronounced peak. At 680, the time-difference histogram having the highest peak value may be determined, and the track containing the best-matching reference sample may be selected as the best match to the unknown music sample. The process 600 may then finish at 690.

Description of Apparatus

Figure 8:
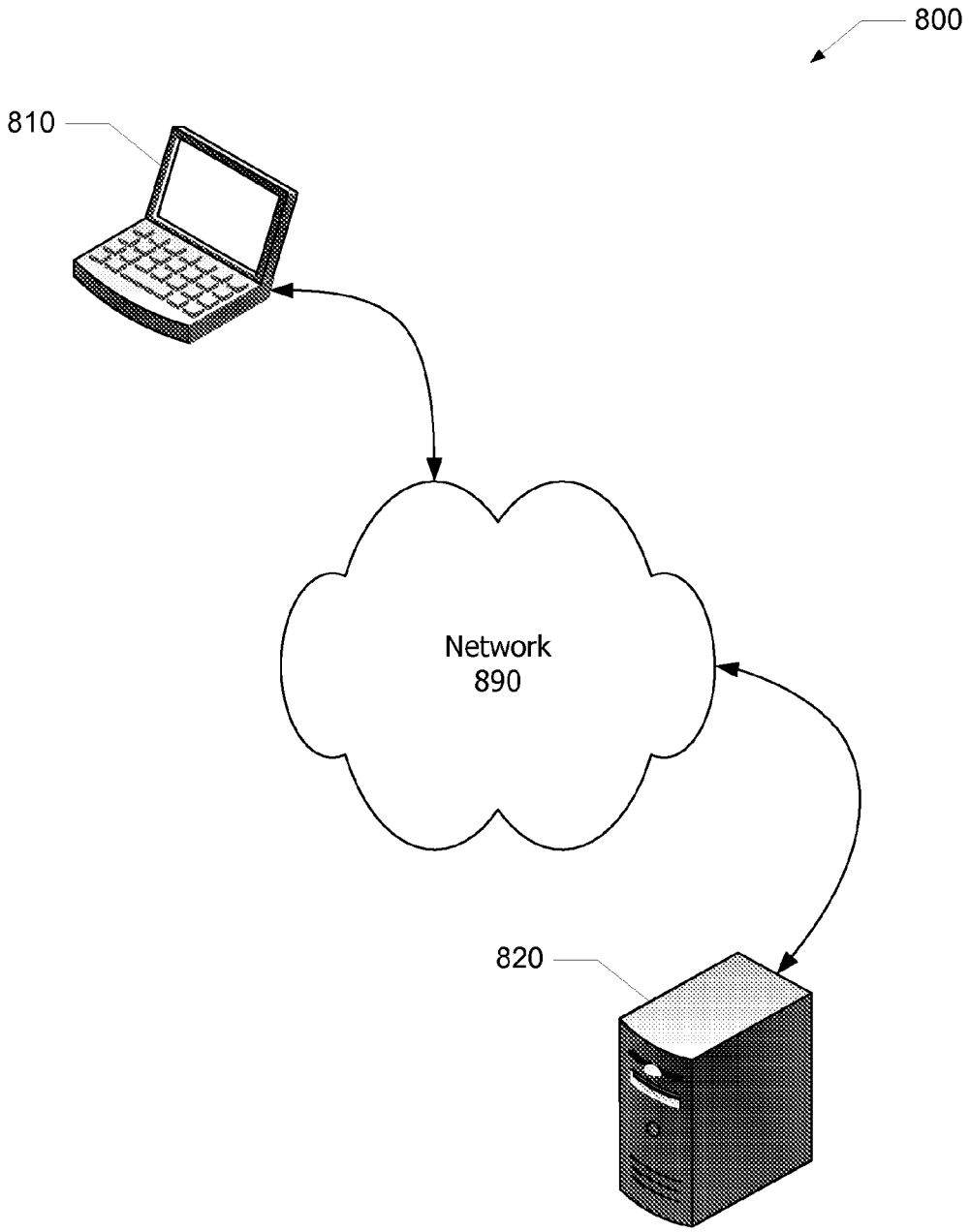
FIG. 8 is a block diagram of a system for fingerprinting music samples.

Referring now to FIG. 8, a system 800 for audio fingerprinting may include a client computer 810, and a server 820 coupled via a network 890. The network 890 may be or include the Internet. Although FIG. 8 shows, for ease of explanation, a single client computer and a single server, it must be understood that a large plurality of client computers and be in communication with the server 820 concurrently, and that the server 820 may comprise a plurality of servers, a server cluster, or a virtual server within a cloud.

Although shown as a portable computer, the client computer 810 may be any computing device including, but not limited to, a desktop personal computer, a portable computer, a laptop computer, a computing tablet, a set top box, a video game system, a personal music player, a telephone, or a personal digital assistant. Each of the client computer 810 and the server 820 may be a computing device including at least one processor, memory, and a network interface. The server, in particular, may contain a plurality of processors. Each of the client computer 810 and the server 820 may include or be coupled to one or more storage devices. The client computer 810 may also include or be coupled to a display device and user input devices, such as a keyboard and mouse, not shown in FIG. 8.

Each of the client computer 810 and the server 820 may execute software instructions to perform the actions and methods described herein. The software instructions may be stored on a machine readable storage medium within a storage device. Machine readable storage media include, for example, magnetic media such as hard disks, floppy disks and tape; optical media such as compact disks (CD-ROM and CD-RW) and digital versatile disks (DVD and DVD±RW); flash memory cards; and other storage media. Within this patent, the term "storage medium" refers to a physical object capable of storing data. The term "storage medium" does not encompass transitory media, such as propagating signals or waveforms.

Each of the client computer 810 and the server 820 may run an operating system, including, for example, variations of the Linux, Microsoft Windows, Symbian, and Apple Mac operating systems. To access the Internet, the client computer may run a browser such as Microsoft Explorer or Mozilla Firefox, and an e-mail program such as Microsoft Outlook or Lotus Notes. Each of the client computer 810 and the server 820 may run one or more application programs to perform the actions and methods described herein.

The client computer 810 may be used by a "requestor" to send a query to the server 820 via the network 890. The query may request the server to identify an unknown music sample. The client computer 810 may generate a fingerprint of the unknown music sample and provide the fingerprint to the server 820 via the network 890. In this case, the process 100 of FIG. 1 may be performed by the client computer 810, and the process 600 of FIG. 6 may be performed by the server 820.

Alternatively, the client computer may provide the music sample to the server as a series of time-domain samples, in which case the process 100 of FIG. 1 and the process 600 of FIG. 6 may be performed by the server 820.

Figure 9:
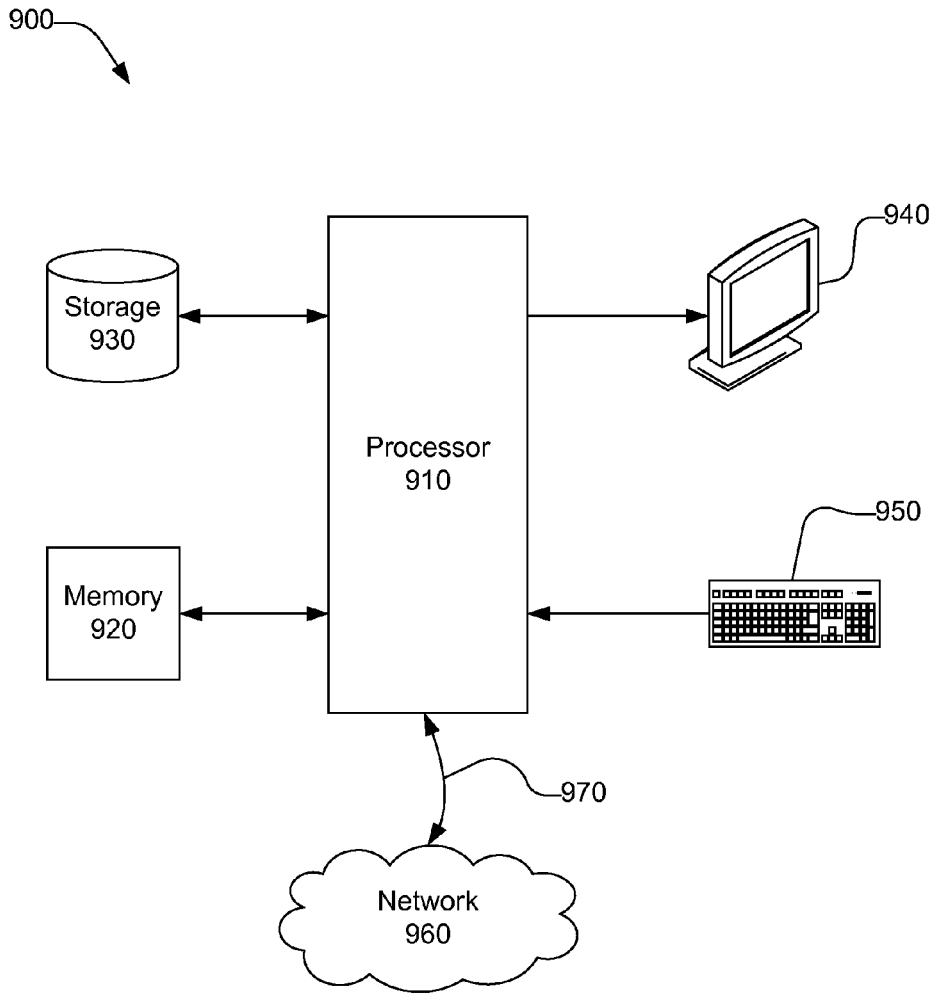
FIG. 9 is a block diagram of a computing device.

FIG. 9 is a block diagram of a computing device 900 which may be suitable for use as the client computer 810 and/or the server 820 of FIG. 8. The computing device 900 may include a processor 910 coupled to memory 920 and a storage device 930. The processor 910 may include one or more microprocessor chips and supporting circuit devices. The storage device 930 may include a machine readable storage medium as previously described. The machine readable storage medium may store instructions that, when executed by the processor 910, cause the computing device 900 to perform some or all of the processes described herein.

The processor 910 may be coupled to a network 960, which may be or include the Internet, via a communications link 970. The processor 910 may be coupled to peripheral devices such as a display 940, a keyboard 950, and other devices that are not shown.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for generating a fingerprint of a music sample, comprising:

filtering the music sample into a plurality of frequency bands independently detecting onsets in each of the frequency bands determining inter-onset intervals between pairs of onsets within the same frequency band generating at least one code associated with each onset, each code comprising a frequency band identifier identifying a frequency band in which the associated onset occurred and one or more inter-onset intervals associating each code with a timestamp indicating when the associated onset occurred within the music sample combining all generated codes and the associated timestamps to form the fingerprint.

2. The method of claim 1, further comprising:

whitening the music sample prior to filtering the music sample.

3. The method of claim 1, wherein detecting onsets comprises, for each frequency band:

comparing a magnitude of the music sample to an adaptive threshold.

4. The method of claim 1, wherein generating at least one code associated with each onset further comprises:

generating a first code containing an inter-onset interval indicating a time interval from an associated onset to a first subsequent onset generating a second code containing an inter-onset interval indicating a time interval from the associated onset to a second subsequent onset different from the first subsequent onset.

5. The method of claim 1, wherein generating at least one code associated with each onset further comprises:

generating a code containing a first inter-onset interval indicating a time interval from an associated onset to a first subsequent onset and a second inter-onset interval indicating a time interval from the associated onset to a second subsequent onset different from the first subsequent onset.

6. The method of claim 1, wherein generating at least one code associated with each onset further comprises:

generating a code containing a first inter-onset interval indicating a time interval from an associated onset to a first subsequent onset and a second inter-onset interval indicating a time interval from the first subsequent onset to a second subsequent onset different from the first subsequent onset.

7. The method of claim 6, wherein generating at least one code associated with each onset further comprises:

generating six different codes, wherein the first subsequent onset and the second subsequent onset within the six codes are selected as all possible pairs of onsets from the four onsets immediately following the associated onset.

8. A computing device for generating a fingerprint of a music sample, comprising:

a processor memory coupled to the processor a storage device coupled to the processor, the storage device storing instructions that, when executed by the processor, cause the computing device to perform actions including:

filtering the music sample into a plurality of frequency bands independently detecting onsets in each of the frequency bands determining inter-onset intervals between pairs of onsets within the same frequency band generating at least one code associated with each onset, each code comprising a frequency band identifier identifying a frequency band in which the associated onset occurred and one or more inter-onset intervals associating each code with a timestamp indicating when the associated onset occurred within the music sample combining all generated codes and the associated timestamps to form the fingerprint.

9. The computing device of claim 8, the actions performed further comprising:

whitening the music sample prior to filtering the music sample.

10. The computing device of claim 8, wherein detecting onsets comprises, for each frequency band:

comparing a magnitude of the music sample to an adaptive threshold.

11. The computing device of claim 8, wherein generating at least one code associated with each onset further comprises:

generating a first code containing an inter-onset interval indicating a time interval from an associated onset to a first subsequent onset generating a second code containing an inter-onset interval indicating a time interval from the associated onset to a second subsequent onset different from the first subsequent onset.

12. The computing device of claim 8, wherein generating at least one code associated with each onset further comprises:

generating a code containing a first inter-onset interval indicating a time interval from an associated onset to a first subsequent onset and a second inter-onset interval indicating a time interval from the associated onset to a second subsequent onset different from the first subsequent onset.

13. The computing device of claim 8, wherein generating at least one code associated with each onset further comprises:

generating a code containing a first inter-onset interval indicating a time interval from an associated onset to a first subsequent onset and a second inter-onset interval indicating a time interval from the first subsequent onset to a second subsequent onset different from the first subsequent onset.

14. The computing device of claim 13, wherein generating at least one code associated with each onset further comprises:

generating six different codes, wherein the first subsequent onset and the second subsequent onset within the six codes are selected as all possible pairs of onsets from the four onsets immediately following the associated onset.

15. A machine readable storage medium storing instructions that, when executed by a computing device, cause the computing device to perform a process for generating a fingerprint of a music sample, the process comprising:

filtering the music sample into a plurality of frequency bands independently detecting onsets in each of the frequency bands determining inter-onset intervals between pairs of onsets within the same frequency band generating at least one code associated with each onset, each code comprising a frequency band identifier identifying a frequency band in which the associated onset occurred and one or more inter-onset intervals associating each code with a timestamp indicating when the associated onset occurred within the music sample combining all generated codes and the associated timestamps to form the fingerprint.

16. The machine readable storage medium of claim 15, the process further comprising:

whitening the music sample prior to filtering the music sample.

17. The machine readable storage medium of claim 15, wherein detecting onsets comprises, for each frequency band:

comparing a magnitude of the music sample to an adaptive threshold.

18. The machine readable storage medium of claim 15, wherein generating at least one code associated with each onset further comprises:

generating a first code containing an inter-onset interval indicating a time interval from an associated onset to a first subsequent onset generating a second code containing an inter-onset interval indicating a time interval from the associated onset to a second subsequent onset different from the first subsequent onset.

19. The machine readable storage medium of claim 15, wherein generating at least one code associated with each onset further comprises:

generating a code containing a first inter-onset interval indicating a time interval from an associated onset to a first subsequent onset and a second inter-onset interval indicating a time interval from the associated onset to a second subsequent onset different from the first subsequent onset.

20. The machine readable storage medium of claim 15, wherein generating at least one code associated with each onset further comprises:

generating a code containing a first inter-onset interval indicating a time interval from an associated onset to a first subsequent onset and a second inter-onset interval indicating a time interval from the first subsequent onset to a second subsequent onset different from the first subsequent onset.

21. The machine readable storage medium of claim 20, wherein generating at least one code associated with each onset further comprises:

generating six different codes, wherein the first subsequent onset and the second subsequent onset within the six codes are selected as all possible pairs of onsets from the four onsets immediately following the associated onset.

* * * * *